US011684551B2

(12) United States Patent
Röhrig

(10) Patent No.: US 11,684,551 B2
(45) Date of Patent: Jun. 27, 2023

(54) BOTTLE TEAT

(71) Applicant: MAM BABYARTIKEL GESELLSCHAFT M.B.H., Vienna (AT)

(72) Inventor: Peter Röhrig, Vienna (AT)

(73) Assignee: MAM BABYARTIKEL GESELLSCHAFT M.B.H., Vienna (AT)

( * ) Notice: Subject to any disclaimer, the term of this patent is extended or adjusted under 35 U.S.C. 154(b) by 119 days.

(21) Appl. No.: 16/641,034

(22) PCT Filed: Aug. 23, 2018

(86) PCT No.: PCT/AT2018/060194
§ 371 (c)(1),
(2) Date: Feb. 21, 2020

(87) PCT Pub. No.: WO2019/036739
PCT Pub. Date: Feb. 28, 2019

(65) Prior Publication Data

US 2021/0030627 A1 Feb. 4, 2021

(30) Foreign Application Priority Data

Aug. 23, 2017 (AT) ..... A 50702/2017

(51) Int. Cl.
*A61J 11/00* (2006.01)
*A61J 11/04* (2006.01)

(52) U.S. Cl.
CPC ..... *A61J 11/006* (2013.01); *A61J 11/045* (2013.01)

(58) Field of Classification Search
CPC .. A61J 11/0035; A61J 11/0055; A61J 11/007; A61J 11/00; A61J 11/006; A61J 11/045
(Continued)

(56) References Cited

U.S. PATENT DOCUMENTS 2,709,434 A 11/1861 Russell
4,505,398 A 3/1985 Kesselring
(Continued)

FOREIGN PATENT DOCUMENTS

CN 101355918 A 1/2009
CN 202724282 U 2/2013
(Continued)

OTHER PUBLICATIONS

Int'l Search Report (Forms PCT/ISA/220 & 210) conducted in Int'l Appln. No. PCT/AT2018/060194 (dated Nov. 27, 2018).
(Continued)

*Primary Examiner* — Jennifer Robertson
*Assistant Examiner* — Jessica Kavini Tamil
(74) *Attorney, Agent, or Firm* — Greenblum & Bernstein. P.L.C.

(57) ABSTRACT

A bottle teat (1) having a base portion (2), which has a connecting flange (3) and in which the bottle teat (1) is substantially circular in a cross section running perpendicularly to a longitudinal axis (9), having a lip-support portion (5) and having a nipple portion (6), which opens out in a teat tip (7), wherein, in a direction perpendicular to its longitudinal axis (9), the bottle teat (1) has, in the lip-support portion (5), a non-circular cross section with a longitudinal axis (10) and a transverse axis (11), which is shorter than the longitudinal axis (10), characterized in that the base portion (2) and the lip-support portion (5) have provided between them a flex portion (4), which has enhanced flexibility in relation to the base portion (2) and the lip-support portion (5), wherein the flex portion (4) has a circumferentially encircling depression (15) in the form of anindent (19) and/or of a smaller wall thickness than in the portions adjacent to the depression (15), and therefore, about an axis running substantially in the direction of the transverse axis
(Continued)

(11), the bottle teat (1) has a level of flexibility, for the purpose of pivoting the lip-support portion (5) and nipple portion (6), which is enhanced in relation to a similarly designed bottle teat without a depression.

23 Claims, 4 Drawing Sheets

(58) Field of Classification Search
USPC ..... 215/11.1
See application file for complete search history.

(56) References Cited

U.S. PATENT DOCUMENTS

| | | | | |
|---|---|---|---|---|
| 4,834,099 | A * | 5/1989 | Schrooten | A61J 11/004 215/11.1 |
| 5,190,174 | A * | 3/1993 | Klag | A61J 11/004 215/11.1 |
| 8,910,810 | B2 | 12/2014 | Rees et al. | |
| 9,295,615 | B2 | 3/2016 | Tollman | |
| 9,561,157 | B2 | 2/2017 | Knight et al. | |
| 2004/0220618 | A1* | 11/2004 | Rohrig | A61J 11/0065 606/234 |
| 2005/0247658 | A1* | 11/2005 | Renz | A61J 11/006 215/11.1 |
| 2010/0140204 | A1* | 6/2010 | Vischer | A61J 11/00 215/11.1 |
| 2013/0140260 | A1* | 6/2013 | Dunn | A61J 11/006 215/11.4 |
| 2014/0217053 | A1 | 8/2014 | Knight et al. | |
| 2015/0174011 | A1* | 6/2015 | Lo | A61J 11/0035 222/633 |
| 2016/0081884 | A1 | 3/2016 | Palmer et al. | |
| 2017/0112720 | A1 | 4/2017 | Wagenknecht et al. | |

FOREIGN PATENT DOCUMENTS

| | | | | |
|---|---|---|---|---|
| CN | 107007475 | A | 8/2017 | |
| CN | 107822897 | A * | 3/2018 | |
| DE | 3241845 | | 5/1984 | |
| DE | 102015118252 | | 4/2014 | |
| EP | 0757909 | A1 * | 2/1997 | A61J 17/001 |
| FR | 2 854 322 | | 11/2004 | |
| FR | 2910806 | A1 | 7/2008 | |
| JP | H0312163 | | 1/1991 | |
| JP | H05-041550 | | 6/1993 | |
| RU | 2 594 257 | | 1/2015 | |
| WO | 2013/144624 | | 10/2013 | |
| WO | 2013/150460 | | 10/2013 | |
| WO | WO-2017213559 | A1 * | 12/2017 | A47G 19/2272 |

OTHER PUBLICATIONS

Int'l Written Opinion (Form PCT/ISA/237) conducted in Int'l Appln. No. PCT/AT2018/060194 (dated Nov. 27, 2018).

Austria Search Report/Office Action conducted in counterpart Austria Appln No. A 50702/2017 (dated Apr. 27, 2018).

Russia Search Report/Office Action conducted in counterpart Russia Appln No. 2020111140/14(018736) (dated Oct. 6, 2020).

Office action of counterpart Japanese patent application No. 2020-511245, dated Dec. 14, 2021, and English language translation thereof.

First Office action of counterpart Chinese patent application No. 201880054848.9, dated Dec. 1, 2021, and English language translation thereof.

* cited by examiner

BOTTLE TEAT

The invention relates to a bottle teat having a base portion comprising a connecting flange and in which the bottle teat is substantially circular in a cross-section running perpendicular to a longitudinal axis, a lip support portion and a nipple portion which opens out in a teat tip, wherein, in a direction perpendicular to its longitudinal axis, the bottle teat comprises, in the lip support portion, a non-circular cross-section with a longitudinal axis and a transverse axis which is shorter compared to the longitudinal axis.

Bottle teats which are substantially circular in a lower base portion in order to be connected in a simple manner and substantially to a usually circularly configured bottle opening, which however have a non-circular cross-sectional shape adjoining this base portion, so that a special alignment of the bottle teat is predefined during usage thereof, namely an alignment in which the longitudinal axis of the bottle teat runs substantially in the direction of longitudinal extension of the lips or the mouth of the baby using the bottle teat are fundamentally known.

Thus, a bottle teat having such a shape which differs from a circular shape above a base portion is known, for example, from FR 2 854 322 B.

Such bottle teats in particular have the advantage that a bending of the bottle teat around a usually concavely curved outer surface of the bottle teat in the lip support region is relatively easily possible, i.e. the bottle teat comprises a relatively high flexibility for a pivoting about an axis running in the direction of the longitudinal axis or in the transverse direction thereto, i.e. in the direction of the transverse axis. As a result of their cross-sectional geometry however, such bottle teats are frequently configured to be comparatively inflexible perpendicular thereto so that it is only possible for the nipple portion in particular to pivot out perpendicular to the transverse axis to a limited extent.

Various bottle teats are already known from the prior art by means of which an increased flexibility of the bottle teat, in particular of the nipple and/or lip support portion, should be achieved.

Known from DE 3241845 A1 is a bottle teat which comprises a plurality of circumferential depressions running to and fro in the shaft region in the manner of a concertina.

Another bottle teat is known from WO 2013/144624 A1 which comprises a circumferential depression in a portion of the bottle teat adjoining a fastening flange.

Also disclosed in DE 102015118252 A1 is a bottle teat which comprises a circumferential drawn-in region 8 adjacent to the teat flange.

Known from U.S. Pat. No. 2,709,434 is a suction part with annular circumferential shoulders or ribs on the outside, which have annularly weakened areas with reduced wall thickness. In this case however, this is a rotationally symmetrical teat over the entire height when viewed in the cross-section perpendicular to the longitudinal axis so that, as expected, a substantially rotationally symmetrical bending behaviour of the bottle teat is obtained with the circumferential weakening of the wall thickness running in a plane perpendicular to the longitudinal axis.

Another bottle teat designed to be rotationally symmetrical over the entire height is known from U.S. Pat. No. 5,190,174 which comprises circumferential wave-shaped depressions in a plane perpendicular to the longitudinal axis to form a bellows-shaped portion to enhance the flexibility.

Also known from U.S. Pat. No. 4,505,398 is a bottle teat configured to be rotationally symmetrical in the lip support region, in which under the lip support region there is a wave-shaped cross-sectional shape to form a bellows-like portion to enhance the flexibility of the bottle teat in this region.

Further known from WO 2013/150460A1 is a bottle teat which comprises material weakenings distributed over the circumference so that the bottle teat can be transferred between a position collapsed into itself in which the nipple portion is depressed and the flexible portion is substantially convexly curved, and an extended position of the nipple portion in which the flexible portion is configured to be planar in sections.

When taking in food, children frequently perform turbulent or hectic movements with the result that it is then difficult for the feeding parent to keep the bottle teat centred to the mouth. The intake of food is the greatest satisfaction for the baby and should therefore function in a good and satisfying manner. The aim of the present invention is accordingly to achieve an enhanced flexibility of the nipple portion substantially in the longitudinal direction of the bottle teat in the lip support portion or in the direction of longitudinal extension of the mouth opening in a usage state in a bottle teat of the type mentioned initially, i.e. in a bottle teat of which a lip support portion differs from a rotationally symmetrical shape. As a result, in particular the comfort for the baby when taking in food should be enhanced.

This object is achieved by the bottle teat having the features of claim 1. Preferred embodiments are given in the dependent claims.

For the purpose of this disclosure, the position and direction information such as "top", "bottom" etc. relate to the intended usage state of the bottle teat if this is mounted in an upright baby bottle, i.e. with a vertical alignment of the longitudinal axis of the bottle teat.

According to the invention, it is provided that between the base portion and the lip support portion there is provided a flexible portion comprising enhanced flexibility with respect to the base and the lip support portion, wherein the flexible portion comprises a circumferentially encircling depression in the form of an indent and/or a smaller wall thickness in portions adjacent to the depression so that about an axis running substantially in the direction of the transverse axis, the bottle teat comprises an enhanced flexibility compared to a similarly configured bottle teat without a depression for pivoting the lip support and nipple portions.

Consequently, the bottle teat according to the invention comprises a circumferential depression so that in addition to the flexibility given in any case in a pivoting direction in the direction of the transverse axis, an enhanced flexibility for pivoting the lip support and nipple portion in the longitudinal direction of the rotationally symmetrically configured lip support portion is achieved. Thus, despite the rotationally asymmetrical configuration, a bottle teat can be achieved which both in the longitudinal and in the transverse direction enables a simple adaptation of the alignment of the lip support portion and therefore also of the nipple portion in use. The sucking comfort for a baby or infant using the bottle teat is herewith improved.

In order to achieve an enhanced flexibility of the bottle teat in the flexible portion formed below the lip support portion, it is favourable if the depression runs substantially along a line of intersection and/or contact line of an imaginary cone with the bottle teat, wherein a tip of the imaginary cone is disposed on the longitudinal axis in a portion which encloses the teat tip and which adjoins the teat tip and the line of intersection runs adjacently or coincidentally with a tangential contact line of the imaginary cone and the bottle teat. By this means, a reduction in the stability of the bottle teat is achieved precisely in that region in which the forces causing a pivoting of the teat tip which are initiated by a baby using the bottle teat, discharge.

In such a configuration, a profile of the depression is thus achieved which comprises a profile which deviates from a cross-sectional plane perpendicular to the longitudinal axis of the bottle teat. As a result of the rotationally asymmetrical shape of the bottle teat, in the case of a depression running along an imaginary cone, a depression is obtained which is arranged higher in the longitudinal axis in a side view than in a cross-sectional area running through the transverse axis. In vertical sectional planes running through the longitudinal axis, this thus results in two highest points of the depression whereas in a vertical sectional plane running through the transverse axis, two low points of the circumferential depression are obtained. Consequently, the profile of the depression differs fundamentally from the profile of known indents or material weakenings in a cross-sectional area running perpendicular to the longitudinal axis, as it is known in the prior art of rotationally symmetrical bottle teats.

The profile of the depression is in this case selected in such a manner that the bottle teat comprises a higher flexibility in the flexible portion for pivoting the lip support and nipple portions about an axis running substantially in the direction of the transverse axis than about an axis running in the direction of the longitudinal axis. Advantageously, a rotationally asymmetrical bottle teat is thus obtained which, as a result of the enhanced flexibility in the direction of the longitudinal axis on account of the depression in the flexible portion, enables the nipple portion to pivot out easily. In addition however, a pivoting of the nipple portion in a perpendicular direction thereto, i.e. in the direction of the transverse axis, is also possible, wherein the pivoting in this direction primarily takes place via a bending of the bottle teat in the direction of the lip support section. Preferably a bottle teat can thus be achieved in which substantially the same bending forces are required for pivoting the lip support and nipple portion about the longitudinal and transverse axis; i.e. despite the rotationally asymmetrical configuration of the bottle teat, the bottle teat comprises a substantially rotationally symmetrical pivoting behaviour of the lip support and nipple portion.

In order to achieve a particularly high flexibility, it is advantageous if the thickness of the wall in the area of the depression is at least 30%, preferably at least 50% smaller than in an area adjoining the depression.

Furthermore, it is advantageous for the formation of a defined bending line which promotes a bending of the bottle teat in the flexible portion if the outer surface of the bottle teat is concavely curved in the area of the indent, wherein the concave curvature comprises a circumferential crest line. Thus, a type of bending line is defined via the crest line, along which, upon application of forces which strive to pivot the bottle teat from a position substantially coincident with the longitudinal axis of the teat, the bottle teat bends.

If an outer surface of the bottle teat is convexly curved in an area above and/or below adjacent to the depression, an enhanced stability is achieved as a result of the curvature in the area adjacent to the depression so that it is reliably ensured that a bending of the bottle teat is achieved in the area of the depression and not in an undesirable manner in an area adjacent to the depression.

With regard to a particularly high suction comfort, it is provided according to the invention that the bottle teat is configured to be rotationally asymmetrical not only on the lip support portion but that the bottle teat in the nipple portion comprises a non-circular cross-section with a longitudinal axis and a shorter transverse axis compared to the longitudinal axis. Such a configuration is particularly favourable from the ergonomic viewpoint for receiving the nipple portion and the lip support portion in the mouth or oral cavity of the baby.

Furthermore, for stiffening the bottle teat in an area at the top adjacent to the depression, it is favourable if above the depression and adjacent to the depression the bottle teat comprises an inwardly projecting bead-like material reinforcement which preferably runs over the entire circumference. Thus, it is further ensured that the bottle teat does not bend in an area in which this is not desirable.

In order to further achieve a substantially resilient mounting of the bottle teat acting over the entire circumference, it is advantageous if under the flexible portion the bottle teat comprises a cross-sectional narrowing, which is adjoined by the connecting flange.

In this cross-sectional narrowing, an inwardly projecting collar of a fastening ring can also be advantageously accommodated so that an intrinsic connection is obtained between bottle teat and fastening ring when connecting to a baby bottle.

Other than in the area of the depression, in the area of the cross-sectional narrowing however, no bending of the bottle teat is provided under appropriate loading during usage, consequently it is advantageous if the bottle teat comprises a substantially constant wall thickness in the area of the cross-sectional narrowing.

If the bottle teat comprises a concavely curved outer surface at least in sections, preferably throughout, in a cross-sectional area running in the direction of the transverse axis in the lip support region, the concavely curved outer surface of the bottle teat in the lip support portion promotes a pivoting-out of the nipple portion in the direction of the transverse axis, i.e. perpendicular to the direction in which an enhanced flexibility is achieved in particular with the depression according to the invention.

If the bottle teat comprises a planar or convexly curved outer surface at least in sections, in a cross-sectional area running in the direction of the longitudinal axis in the lip support region or the outer surface is composed of a combination of a planar and convexly curved surface, an increased stiffening of the bottle teat in a pivoting direction about the transverse axis of the bottle teat is thereby achieved. Accordingly, it is particularly advantageous with such a configuration of the bottle teat if the bottle teat comprises a depression according to the invention.

With regard to particularly good sucking comfort which is based on the configuration of the maternal nipple, it is advantageous if the outer surface of the bottle teat comprises a convexly curved section in the nipple area both in a cross-sectional area running parallel to the longitudinal axis and also to the transverse axis.

For a particularly reliable connection of the bottle teat to a fastening ring, it is advantageous if the connecting flange comprises a preferably circumferential groove on its upper side. If such a preferably circumferential groove is provided, one or more ribs which are provided on the underside of an inwardly projecting collar of the fastening ring can be accommodated in the position fastened to a baby bottle so that a positive connection is obtained between the projecting ribs or a circumferential rib and the groove on the upper side of the connecting flange.

In order to achieve a particularly tight connection of the bottle teat to an upper edge of a bottle opening, it is favourable if on its underside the connecting flange comprises a circumferential groove preferably running according to an edge of an upper connecting opening of a container.

Furthermore, for sealing the bottle teat with respect to an opening over an edge of a drinking bottle, it is favourable if on its underside, preferably adjacent to the groove, the connecting flange comprises a downwardly projecting sealing lip.

The invention will be explained in further detail hereinafter with reference to a preferred exemplary embodiment shown in the drawings to which the invention should however not be restricted in any way.

Figure 1:
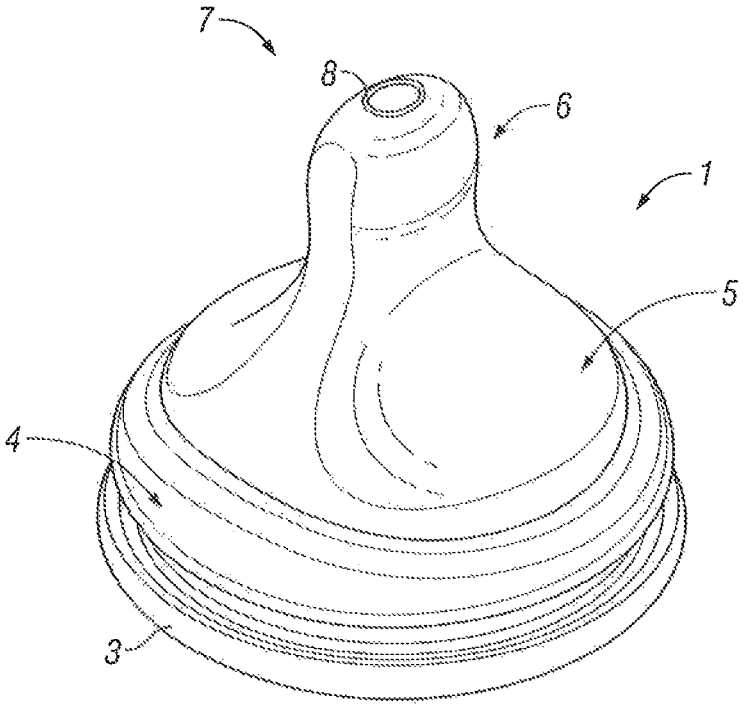
FIG. 1 shows a perspective view of the bottle teat according to the invention from above.
Figure 2:
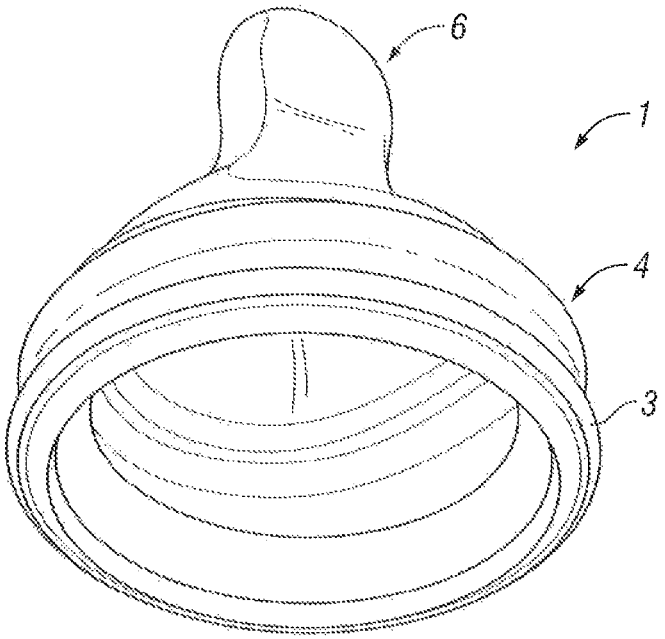
FIG. 2 shows a perspective view of the bottle teat according to the invention from below.
Figure 3:
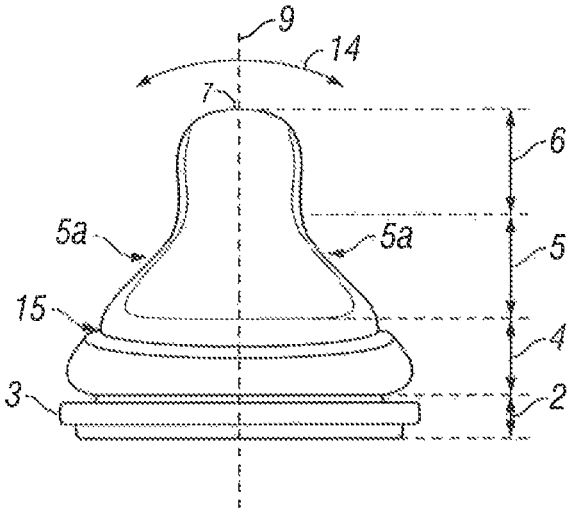
FIG. 3 shows a side view of the bottle teat in the direction of the transverse axis in the area of a lip support and nipple portion.

FIGS. 1 and 2 each show perspective views of a bottle teat 1 which, as can be seen from FIG. 3 in particular, can be divided into the following portions:

Firstly, a base portion 2 which comprises a connecting flange 3 is provided in a lower end portion. The base portion 2 is then adjoined by a flexible portion 4. Above the flexible portion 4 a lip support portion 5 is provided, which is adjoined by a nipple portion 6 as upper end portion, which opens into a teat tip 7. The teat tip 7 comprises a suction opening 8 for liquid to pass through. The bottle teat 1 comprises a concavely curved outer surface 5a at least in sections, preferably throughout, in a cross-sectional area running in the direction of the transverse axis 11 in the lip support portion 5.

Figure 4:
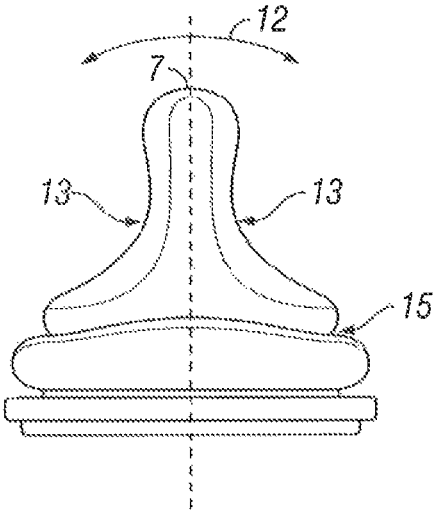
FIG. 4 shows a side view turned through 90° with respect to FIG. 3 in the direction of the longitudinal axis in the lip support and nipple portion.
Figure 5:
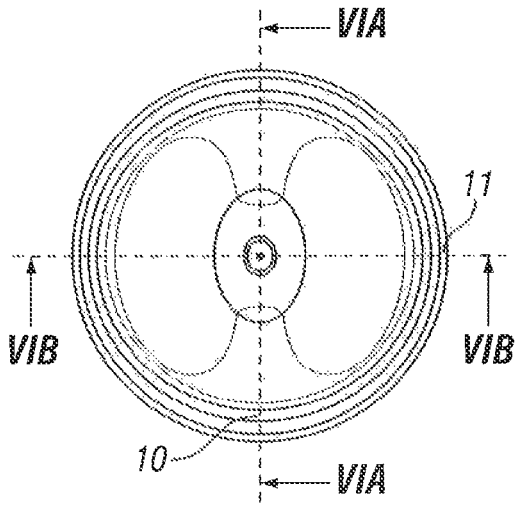
FIG. 5 shows a plan view of the bottle teat according to FIGS. 1 to 4.

As can be seen from the perspective views according to FIGS. 1 and 2 and from a comparison of FIGS. 3 and 4 and also in FIG. 5, the bottle teat 1 is configured to be rotationally symmetrical in its lower base portion 2, i.e. it comprises a substantially circular shape in a cross-section perpendicular to its longitudinal axis 9.

Above the base portion 2 in the area of the lip support portion 5 and in the nipple portion 6, the bottle teat when viewed in a cross-section perpendicular to the longitudinal axis 9, comprises a non-circular, approximately elliptical cross-section with a greater extension in the direction of a longitudinal axis 10 and a shorter extension in the direction of a transverse axis 11 compared to the longitudinal axis (cf. FIG. 5).

As a result of this cross-sectional geometry, it is found that the bottle teat without flexible portion 4 comprises a relatively good flexing behaviour when pivoting the nipple portion 6 in the direction of the transverse axis 11, i.e. when the teat tip 7 pivots out in the direction of the arrow 12. In this case, the teat 1 in the nipple portion 5 bends substantially about a bending zone 13 when pressure is applied by the baby using the bottle teat.

For a pivoting-out of the teat tip 7 in the direction of the arrow 14 (cf. FIG. 3), as a result of the geometrical configuration of the bottle teat 1 however, without the flexible portion 4, a comparatively high application of force would be required since the outer surface of the bottle teat 1 is configured to be substantially planar or slightly convex in the area of the lip support portion so that a stiffening is obtained in this area.

In order to improve the flexing behaviour of the bottle teat 1 for a pivoting of the teat tip 7 and the lip support portion in the direction of the arrow 14, i.e. about an axis running in the direction of the transverse axis 11, the bottle teat 1 comprises a flexible portion 4.

Figure 6:
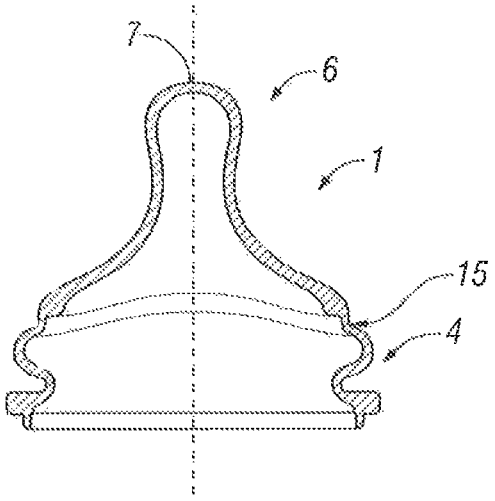
FIG. 6 shows a section along the line VIB-VIB in FIG. 5 along the transverse axis in the lip support section.

In the flexible portion 4 a depression 15 is provided, which, as can be seen in FIG. 6, runs substantially along a line of intersection or contact line of an imaginary cone 15*a* with the outer surface of the bottle teat 1 in the flexible portion 4. Here a cone 15*a* is provided, the tip of which is disposed on the longitudinal axis 9 in a portion 17 which encloses the teat tip 7 and which adjoins the teat tip 7. This portion 17 in particular comprises a length of up to 5 mm above and below the teat tip, wherein in the exemplary embodiment shown preferably the cone tip is arranged about 2 mm above the teat tip 7.

Figure 6A:
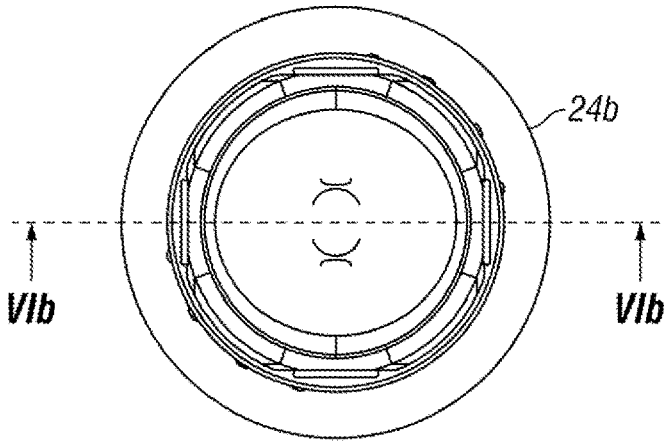
FIG. 6A shows a plan view of a baby bottle with a bottle teat according to the invention according to FIGS. 1 to 5.

The imaginary cone 15*a* is then, preferably when viewed substantially centrally over the extension of the flexible portion, placed in the flexible portion 4 below the lip support portion 5 at a flat angle onto the outer surface of the bottle teat 1 so that a circumferential line of intersection is obtained. The line of intersection runs, other than in rotationally symmetrical bottle teats, with a depression to increase the flexibility not along a cross-sectional plane running perpendicular to the longitudinal axis 9 but, as a result of the asymmetrical configuration of the teat 1 in the flexible portion 4, the circumferentially encircling depression comprises an ascending and descending profile when viewed over, or as the depression extends along, the circumference. As shown in FIG. 4 for exam ale the profile of the circumferentially encircling depression ascends and descends along the longitudinal axis of the bottle teat 9. As a result of the geometrical configuration of the bottle teat 1, in the area of a vertical section surface placed through the longitudinal axis 10, two maxima 18*a* are obtained in the profile of the depression and two minima 18*b* in the direction of the transverse axis 11, as can be seen in particular in the section plane shown in FIGS. 6 and 6A along the transverse axis.

Thus, as a result of the geometry of the bottle teat 1 over the circumferential depression 15, substantially a bending of the bottle teat 1 is achieved when a force acts in the direction of the arrow direction 14, i.e. during a pivoting movement of the nipple portion 6 and the lip support portion 5 about an axis running in the direction of the transverse axis 11 so that a significantly improved bending behaviour of the teat 1 is achieved as a result.

Figure 8:
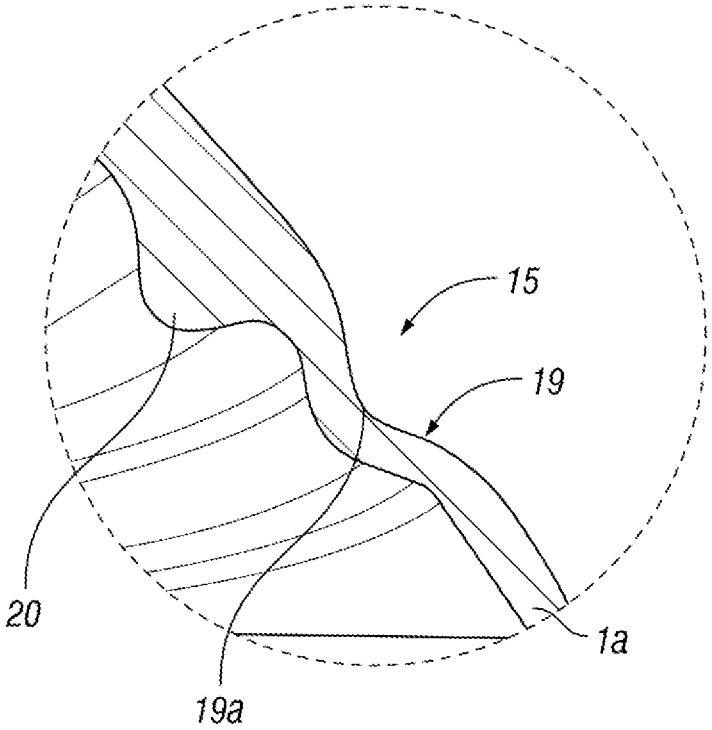
FIG. 8 shows the detail VIII according to FIG. 7.

In order to facilitate the bending of the bottle teat 1 in the area of the flexible portion 4 when pressure is applied in the nipple portion 6 and/or lip support portion 5, the teat comprises the said depression 15 in the lip support portion 5, which is shown in detail in FIG. 8. Here it can be seen that in the exemplary embodiment shown, the bottle teat 1 comprises a reduced wall thickness of about 0.6 mm to 1 mm, preferably of about 0.8 mm in the area of the depression 15, whereas the wall thickness in the lip support portion 5 is usually about 1.2 mm to 2 mm. Furthermore, the profile of the wall 1*a* of the bottle teat 1 comprises an indent 19, i.e. the profile of the wall 1*a* of the bottle teat 1 comprises a concave profile in this area, which comprises a crest 19*a* which substantially serves as a bending line.

In order to reliably prevent any collapse of the bottle teat 1 in a portion adjoining the depression 15, a bead-like, inwardly projection material reinforcement 20 is provided in particular above the depression 15. In this area, the wall 1*a* of the bottle teat 1 comprises a wall thickness about 2 to 4 times greater than that in the area of the depression 15 so that when a pressure is applied in this area, the bottle teat 1 does not yield but the desired bending in the adjoining area of the depression 15 is achieved.

Naturally, the depression 15 can also be achieved merely via the geometrical configuration, i.e. a concave indent 19 or by a groove-like material recess, i.e. wall thickness narrowing, on the outer surface of the bottle teat 1.

Figure 6B:
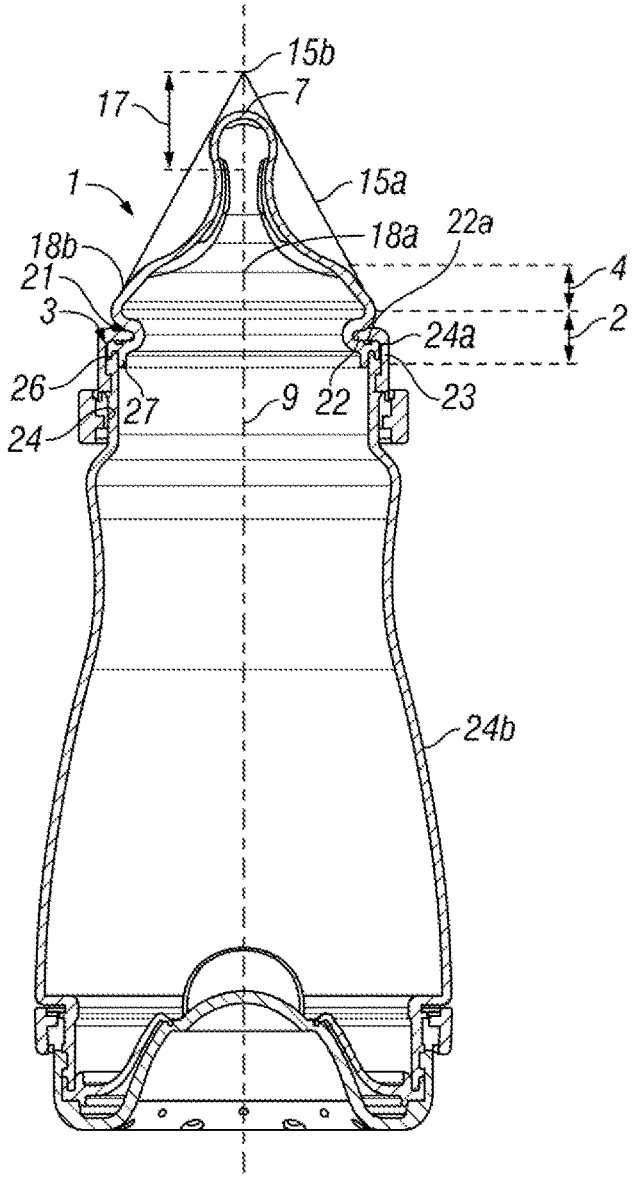
FIG. 6B shows a sectional view along the line VIb-VIb in FIG. 6A with an imaginary cone defining the profile of a depression in the flexible portion.
Figure 7:
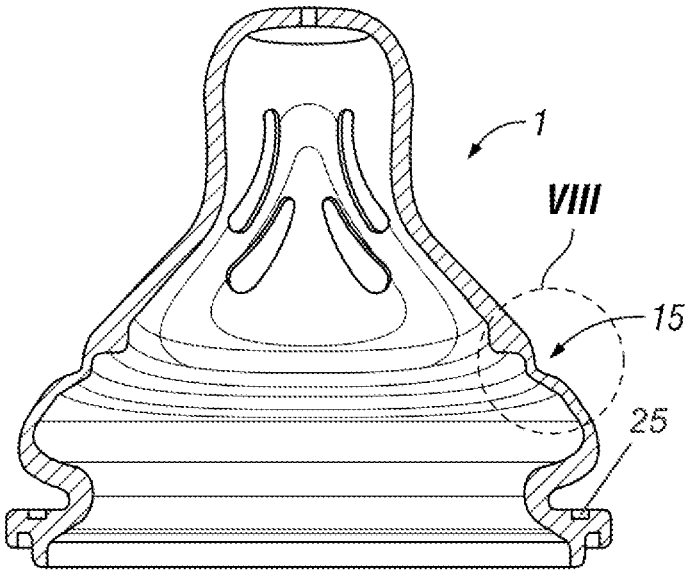
FIG. 7 shows a sectional view according to the line VIA-VIA in FIG. 5 along the longitudinal axis in the lip support region.

In particular it can also be seen in FIG. 6B that in the base portion 2 a cross-sectional narrowing 21 is provided which on the one hand forms a resilient base for the entire soother portion arranged thereabove and additionally also serves to receive an inwardly projecting collar 22 of a fastening ring 23.

The fastening ring 23 can in this case advantageously also comprise downwardly projecting webs 22*a* or a circularly running web 22*a*, which in the position connected to the bottle opening 24 of a bottle 24*b* cooperate in a circumferential groove 25 arranged on the upper side of the connecting flange. As a result of the form fit receipt of the web or the webs 22*a* in the groove 25, a form fit connection is thus achieved between connecting flange 3 and fastening ring 23.

Furthermore, on its underside the connecting flange 3 comprises a circumferential groove or depression 26 which receives an upper edge 24*a* of a bottle opening 24 to which the bottle teat 1 is fastened. This also results in a reliable, sometimes connection of the bottle teat 1 to the bottle opening 24.

With regard to a good seal of the connection between fastening ring 23 and the bottle opening 24, it is furthermore advantageous if the connecting flange 3 of the bottle teat 1 comprises a sealing lip 27 which adjoins the underside circumferential groove 26 circumferentially on the inside to receive the edge 24*a* of the bottle opening 24. Thus, in particular a reliable connection of the bottle teat into the bottle opening 24 can also be achieved with a snap connection between fastening ring 23 and bottle opening 24.

The invention claimed is:

1. A bottle teat comprising:

a base portion comprising a connecting flange;

the bottle teat is substantially circular in a cross section running in a direction perpendicular to a longitudinal axis of the bottle teat;

a lip support portion and a nipple portion, the nipple portion opening into a teat tip;

in a direction perpendicular to the longitudinal axis, the bottle teat comprising, in the lip support portion, a non-circular cross section having a cross-sectional longitudinal axis and a cross-sectional transverse axis, the lip support portion extending less transversely than longitudinally;

a flexible portion provided between the base portion and the lip support portion, the flexible portion having enhanced flexibility with respect to the base portion and the lip support portion;

the flexible portion comprising:

a circumferentially encircling depression in the form of, in areas adjacent to the depression: (a) an indent, or (b) a wall thickness narrowing, or (c) both an indent and a wall thickness narrowing;

the circumferentially encircling depression having an ascending and descending profile as the depression extends along the circumference of the depression whereas in side view in the direction of the cross-sectional longitudinal axis the profile ascends towards the cross-sectional longitudinal axis and in a side view in the direction of the cross-sectional transverse axis the profile descends towards the cross-sectional transverse axis so that, about an axis extending substantially in a direction of the cross-sectional transverse axis, the bottle teat has an enhanced flexibility compared to a similarly configured bottle teat without a depression for pivoting the lip support portion and the nipple portion.

2. A bottle teat according to claim 1, wherein:

the depression runs substantially along a line of intersection or a contact line of an imaginary cone with the bottle teat;

a tip of the imaginary cone is disposed on the longitudinal axis in a portion that encloses the teat tip and that adjoins the teat tip, and the line of intersection runs adjacently or coincidentally with a tangential contact line of the imaginary cone and the bottle teat.

3. A bottle teat according to claim 1, wherein:

a thickness of the wall of the bottle teat in an area of the depression is at least 30% smaller than in an area adjoining the depression.

4. A bottle teat according to claim 1, wherein:

a thickness of the wall of the bottle teat in an area of the depression is at least 50% smaller than in an area adjoining the depression.

5. A bottle teat according to claim 1, wherein:

an outer surface of the bottle teat is concavely curved in the area of the depression; and the concave curvature comprises a circumferential crest line.

6. A bottle teat according to claim 1, wherein:

an outer surface of the bottle teat is convexly curved: in an area above adjacent to the depression, or below adjacent to the depression, or both above adjacent to the depression and below adjacent to the depression.

7. A bottle teat according to claim 1, wherein:

in the flexible portion or in the nipple portion the bottle teat comprises a non-circular cross section with a cross-sectional longitudinal axis and a shorter cross-sectional transverse axis compared to the longitudinal axis.

8. A bottle teat according to claim 1, wherein:

above the depression and adjacent to the depression the bottle teat comprises an inwardly projecting bead-like material reinforcement.

9. A bottle teat according to claim 8, wherein:

the inwardly projecting bead-like material reinforcement runs over the entire circumference.

10. A bottle teat according to claim 1, wherein:

under the flexible portion the bottle teat comprises a cross-sectional narrowing that is adjoined by the connecting flange.

11. A bottle teat according to claim 10, wherein:

the bottle teat comprises a substantially constant wall thickness in an area of the cross-sectional narrowing.

12. A bottle teat according to claim 1, wherein:

the bottle teat comprises a concavely curved outer surface at least in sections in a cross-sectional area running in the direction of the cross-sectional transverse axis in the lip support region.

13. A bottle teat according to claim 1, wherein:

the bottle teat comprises a concavely curved outer surface throughout in a cross-sectional area running in the direction of the cross-sectional transverse axis in the lip support region.

14. A bottle teat according to claim 1, wherein:

the bottle teat comprises a planar or convexly curved outer surface at least in sections, in a cross-sectional area running in the direction of the cross-sectional longitudinal axis in the lip support region or the outer surface is composed of a combination of a planar and convexly curved surface.

15. A bottle teat according to claim 1, wherein:

the outer surface of the bottle teat comprises a convexly curved section in the nipple area both in a cross-sectional area running parallel to the cross-sectional longitudinal axis and also to the cross-sectional transverse axis.

16. A bottle teat according to claim 1, wherein:

the connecting flange comprises an upper side having a circumferential groove.

17. A bottle teat according to claim 1, wherein:

the circumferential groove is on an upper side of the flange.

18. A bottle teat according to claim 1, wherein:

the connecting flange comprises an underside having a circumferential groove.

19. A bottle teat according to claim 18, wherein:

the circumferential groove is configured to run according to an edge of an upper connecting opening of a container.

20. A bottle teat according to claim 1, wherein:

the connecting flange comprises an underside having a downwardly projecting sealing lip.

21. A bottle teat according to claim 20, wherein:

the connecting flange comprises an underside having a circumferential groove; and the downwardly projecting sealing lip is adjacent to the circumferential groove.

22. A bottle teat according to claim 1, wherein:

the circumferentially encircling depression with the ascending and descending profile as the depression extends along the circumference of the depression at least when the bottle teat is oriented upright along the longitudinal axis of the bottle teat so that, about an axis extending substantially in a direction of the cross-sectional transverse axis, the bottle teat has an enhanced flexibility compared to a similarly configured bottle teat without a depression for pivoting the lip support portion and the nipple portion.

23. A bottle teat according to claim 1, wherein:

the profile of the circumferentially encircling depression ascends and descends along the longitudinal axis of the bottle teat.

* * * * *